US009638204B2

(12) United States Patent
Hayes-Pankhurst et al.

(10) Patent No.: US 9,638,204 B2
(45) Date of Patent: May 2, 2017

(54) PUMP AND ITS MANUFACTURING METHOD

(71) Applicant: QUANTEX PATENTS LTD, London (GB)

(72) Inventors: Richard Paul Hayes-Pankhurst, London (GB); Jonathan Edward Ford, Cambridge (GB)

(73) Assignee: QUANTEX PATENTS LTD, London (GB)

( * ) Notice: Subject to any disclaimer, the term of this patent is extended or adjusted under 35 U.S.C. 154(b) by 16 days.

(21) Appl. No.: 14/435,652

(22) PCT Filed: Oct. 15, 2013

(86) PCT No.: PCT/EP2013/071535
§ 371 (c)(1),
(2) Date: Apr. 14, 2015

(87) PCT Pub. No.: WO2014/060418
PCT Pub. Date: Apr. 24, 2014

(65) Prior Publication Data

US 2015/0260195 A1 Sep. 17, 2015

(30) Foreign Application Priority Data

Oct. 15, 2012 (GB) ..... 1218428.9

(51) Int. Cl.
*F03C 4/00* (2006.01)
*F04C 2/00* (2006.01)
(Continued)

(52) U.S. Cl.
CPC ..... *F04D 29/08* (2013.01); *F01C 19/04* (2013.01); *F01C 19/10* (2013.01); *F04C 5/00* (2013.01);
(Continued)

(58) Field of Classification Search
CPC ..... F01C 1/344; F01C 1/3442; F01C 19/04; F01C 19/10; F01C 21/0845; F04C 2/3443;
(Continued)

(56) References Cited

U.S. PATENT DOCUMENTS 3,771,901 A 11/1973 Svensson
4,543,228 A 9/1985 Bingler
(Continued)

OTHER PUBLICATIONS

International Search Report for PCT/EP2013/071535 dated Dec. 18, 2013.
(Continued)

*Primary Examiner* — Theresa Trieu
(74) *Attorney, Agent, or Firm* — Stephen J. Weyer, Esq.; Stites & Harbison, PLLC

(57) ABSTRACT

A pump assembly comprises an inlet, an outlet and a housing having an inlet aperture in fluid connection with the inlet, and an outlet aperture in fluid connection with the outlet. A rotor located within the housing is shaped to form with an interior surface of the housing a chamber. On rotation of the rotor, the chamber conveys fluid from the inlet aperture to the outlet aperture. The housing carries a seal located in the inlet and urged into contact with the rotor to prevent the passage of fluid past the rotor from the outlet to the inlet. Center lines of the inlet and the outlet are parallel to one another. The outlet can be formed by linear movement of a mold core.

17 Claims, 6 Drawing Sheets

(51) Int. Cl.

| | |
|---|---|
| ***F04C 15/00*** | (2006.01) |
| ***F04D 29/08*** | (2006.01) |
| ***F01C 19/04*** | (2006.01) |
| ***F01C 19/10*** | (2006.01) |
| ***F04C 5/00*** | (2006.01) |

(52) U.S. Cl.

CPC ..... *F04C 15/0015* (2013.01); *F04C 2230/21* (2013.01); *F04C 2240/20* (2013.01); *F04C 2240/802* (2013.01); *F05C 2225/00* (2013.01); *F05C 2225/02* (2013.01); *Y10T 29/49245* (2015.01)

(58) Field of Classification Search

CPC .. F04C 5/00; F04C 2240/20; F04C 2240/802; F04C 2250/20; F04C 2250/10–2250/102; F05C 2203/06; F05C 2225/00; F05C 2225/02

USPC ..... 418/125, 127–129, 152–153, 156, 1; 29/888.025

See application file for complete search history.

(56) References Cited

U.S. PATENT DOCUMENTS

| | | | |
|---|---|---|---|
| 2006/0051228 | A1 | 3/2006 | Hayes-Pankhurst et al. |
| 2012/0034122 | A1 | 2/2012 | Hayes-Pankhurst et al. |
| 2013/0062811 | A1 | 3/2013 | Kimberlin et al. |
| 2014/0255164 | A1 | 9/2014 | Hayes-Pankhurst et al. |
| 2014/0348684 | A1 | 11/2014 | Hayes-Pankhurst et al. |

OTHER PUBLICATIONS

Written Opinion of the International Searching Authority for PCT/EP2013/071535 dated Dec. 18, 2013.

PUMP AND ITS MANUFACTURING METHOD

BACKGROUND

The invention relates to pump assemblies.

The invention relates to a pump assembly of the kind comprising an inlet, an outlet and a pump housing having an inlet aperture in fluid connection with the inlet and an outlet aperture in fluid connection with the outlet, a rotor within the housing and shaped to form with an interior surface of the housing at least one chamber that on rotation of the rotor conveys fluid from the inlet aperture to the outlet aperture, the housing carrying a seal between the inlet and the outlet and located in the inlet and urged into contact with the rotor to prevent the passage of fluid past the rotor from the outlet to the inlet. Such pump assemblies are known from, for example, WO2006/027548 and WO2010/12229.

The location of the inlet aperture and the outlet aperture affects the performance of the pump. The operation of the pump is optimised if respective circumferential edges of the inlet aperture and the outlet aperture have respective portions that are closely adjacent (including at) respective circumferential edges of the seal. If these portions are spaced from these edges, it can create negative pressures locally as the rotor rotates. In addition, the inlet and the outlet apertures, in planes normal to the rotor axis and where they enter to housing, generally extend all or mainly to one side of a diameter of the housing that includes the seal and is normal to a radius of the housing passing through the line of contact of the seal with the rotor ("the contact radius") so that a second portion of the circumferential edge opposite the first portion is spaced further from the contact radius than the first portion.

Where the pump assembly is used to draw fluid from a container, it is advantageous for the inlet and the outlet to open in opposite directions and to be shaped to have respective centre lines that lie in a plane normal to the axis of the rotor. Often, the centre lines will be parallel. This allows the inlet to be a push fit onto an under surface of a container for the supply of fluid to an open end of the inlet and allows the fluid to be dispensed downwardly from an open end of the outlet. Such a pump assembly can be formed by moulding in a process that uses mould tools including cores to form the housing including the seal, the inlet and the outlet and the inlet and outlet apertures.

Where the contact radius is parallel to the centre lines of the inlet and the outlet, the direction of opening of the inlet aperture is towards the open end of the inlet and so the inlet aperture can be formed by moving a simple one-piece first core in a linear movement until a face of the first core abuts a face of a second core forming the interior of the housing and then retracting the first core along the same line. In this case, however, the direction of opening of the outlet aperture is also towards the open end of the inlet and so is away from the open end of the outlet. This prevents the outlet aperture being formed by moving a simple one-piece third core in a linear movement until a face of the third core abuts a face of the second core and by retracting the third core along the same line. It is necessary to use a complicated single core or a number of cores as seen, for example, in PCT/EP2012/069643. This increases the complexity of manufacture and the cost of the pump assembly.

SUMMARY

According to the invention, there is provided a pump assembly comprising an inlet having an open end, an outlet having an open end and a housing having an inlet aperture in fluid connection with the inlet at an end of the inlet opposite said open end and an outlet aperture in fluid connection with the outlet at an end of the outlet opposite said open end, a rotor within the housing and shaped to form with an interior surface of the housing at least one chamber that on rotation of the rotor conveys fluid from the inlet aperture to the outlet aperture, the housing including a seal located between the inlet and the outlet and urged into contact with the rotor along a sealing line to prevent the passage of fluid past the rotor from the outlet to the inlet, the inlet aperture and the outlet aperture having respective portions adjacent respective edges of the seal and the inlet and the outlet having respective centre lines that are parallel to one another and lie in a plane normal to the axis of the housing, a radius of the housing passing through the sealing line being angled relative to the centre lines of the inlet and the outlet.

In this way, the outlet aperture can be formed using a single simple core moving in a linear path in the mould tool since the core has uninterrupted access to form the outlet aperture with the outlet.

BRIEF DESCRIPTION OF THE DRAWINGS

The following is a more detailed description of some embodiments of the invention, by way of example, reference being made to the accompanying drawings, in which.

DETAILED DESCRIPTION

Figure 1:
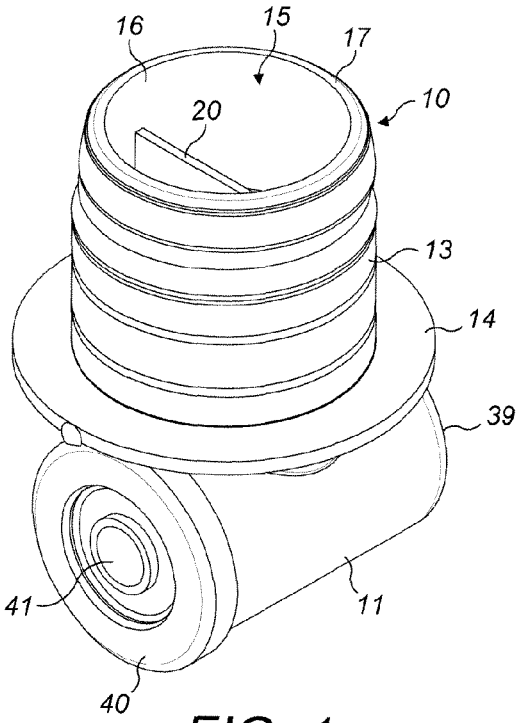
FIG. 1 is a perspective view of a pump assembly from above, one end and to one side.
Figure 2:
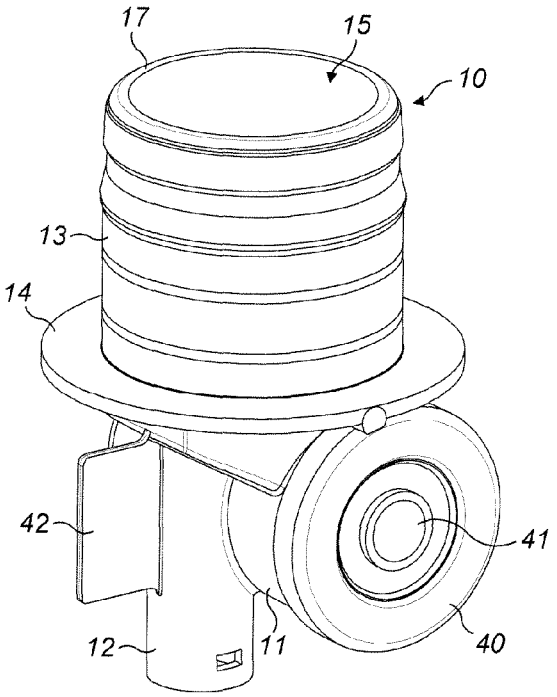
FIG. 2 is a perspective view of the pump assembly of FIG. 1 from above, one end and to the other side.

Referring to the Figures, the pump assembly comprises an inlet 10 leading to a housing 11 from which exits an outlet 12. The pump assembly is formed in one-piece from a suitable plastics material in a manner to be described in more detail below.

The inlet 10 is of circular cross-section and leads to a chamber 69 that sits on top of the housing 11. The chamber 69 has an open upper end and is provided with spaced annular ribs 13 for securing the pump through a push fit into an outlet to a container of liquid (not shown). To allow this connection to be made mechanically, an annular flange 14 is provided around the exterior of the inlet 10 at the base of the inlet 10 for co-operation with a machine (not shown) of known kind for inserting the chamber 69 into the container outlet.

Figure 3:
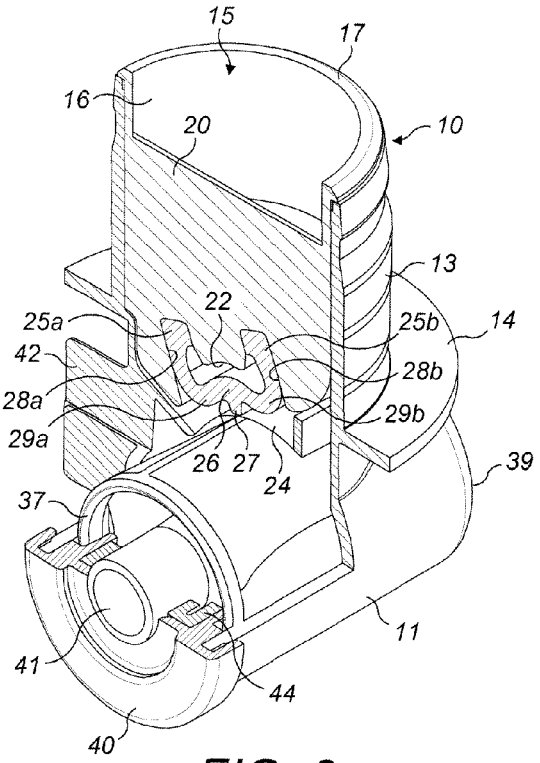
FIG. 3 is a similar view to FIG. 1 but showing an inlet of the pump assembly in cross-section.
Figure 4:
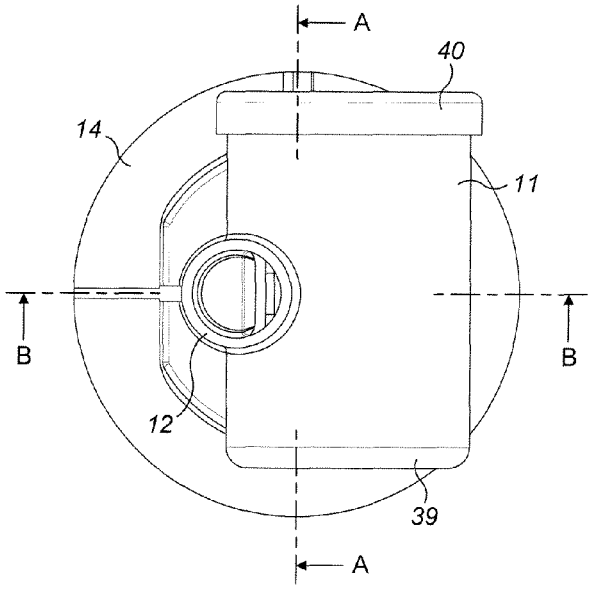
FIG. 4 is a plan view from beneath of the pump assembly of FIGS. 1 to 3.
Figure 5:
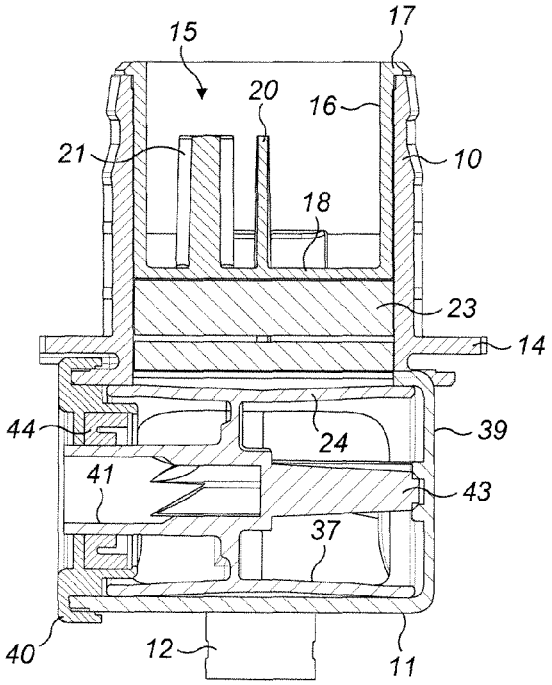
FIG. 5 is a section on the line A-A of FIG. 4.
Figure 6:
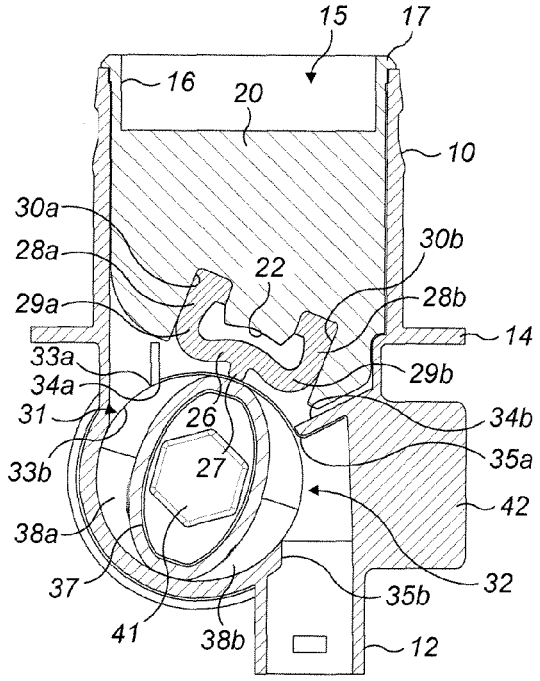
FIG. 6 is a section on the line B-B of FIG. 4.
Figure 7:
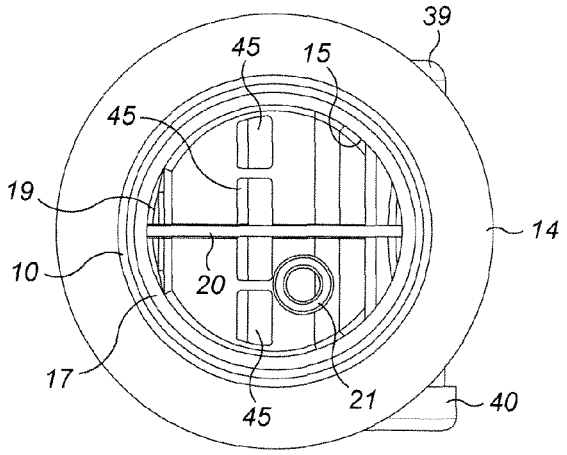
FIG. 7 is a plan view from above of the pump of FIGS. 1 to 5.

The chamber 69 (shown in FIG. 10) contains a cap 15 best seen in FIGS. 3, 5 and 6. The cap 15 has an annular body 16 that is a close fit within the chamber 69 and terminates in an outwardly directed flange 17 that sits on the open end of the chamber 69 and is fixed to the chamber 69 by, for example, ultrasonic welding, to connect the parts together. The cap 15 has, at its lower end, a disc-shaped closure 18 (see FIG. 5) that is provided with a number of passages 19 (see FIG. 7) to allow liquid to pass from the chamber 69 to the inlet 10. As seen in FIGS. 3 and 6, a rib 20 extends upwardly from the closure 18 and diametrically across the cap 15. A tube 21 (see FIGS. 5 and 7) extends upwardly from the closure 18 for holding an evacuation strip of known kind (not shown) that, in use, extends through the outlet of an associated container that is collapsible to prevent a collapsing container blocking the outlet to the container as the container is emptied.

The under surface of the closure 18 is formed with a shaped channel 22 (see FIGS. 3 and 6) that receives a spring 23. The channel 22 and the spring 23 will be described in more detail below.

The housing 11 is generally cylindrical in shape, closed at one end 39 and open at the other end. The axis of the housing 11 is normal to a plane including the centre line of the inlet 10 and the centre line of the outlet 12. The housing 11 is formed integrally with a flexible diaphragm seal 24 that extends along the axial length of the housing 11 and extends circumferentially for about 40° of the housing circumference. The diaphragm seal 24 is supported by the spring 23, which is an elongate member of inverted U-shape cross-section formed from an elastomeric material that is compliant, flexible and resilient, such as silicone rubber. The spring 23 has spaced arms 25*a*, 25*b* interconnected by a base portion 26 carrying a rib 27 on its exterior surface. The rib 27 extends parallel to the longitudinal axis of the member. The free ends of the spaced arms 25*a*, 25*b* are thickened. The spring 23 is inverted in the channel 22 with the outer side faces of the arms 25*a*, 25*b* pressing against the side walls 28*a*, 28*b* so that the ends 29*a*, 29*b* of the base portion 26 are fixed relative to the side walls 28*a*, 28*b*. The rib 27 bears against the under surface of the diaphragm seal 24. The channel 22 includes parallel spaced channels 30*a* 30*b* that receive respective free ends of the arms 25*a*, 25*b* to locate the spring 23 relative to the cap 15 and thus relative to the housing 11. The cap 15 compresses the spring 23 so that the rib 27 is forced against the diaphragm seal 24. The spring 23 and the seal 24 are thus located at the lower end of the chamber 69.

The construction and operation of the spring 23 and similar springs is described in more detail in our PCT patent application no. PCT/EP2012/069646.

The housing 11 is formed with an inlet aperture 31 leading from the inlet 10 to the interior of the housing 11 and an outlet aperture 32 leading from the interior to the outlet 12. The outlet 12 is a tube of generally circular cross-section with an axis parallel to but spaced from the centre line of the inlet 10 and terminating in an open end.

The inlet aperture 31 has, in planes normal to the axis of the housing 11, a maximum dimension between a first portion 33*a* of the inlet aperture 31 adjacent a first lateral edge 34*a* of the seal 24 and a second portion 33*b* of the inlet aperture 31 to the same side as the seal 24 of a diameter of the housing 11 that is normal to a diameter of the housing 11 that passes through the centre of the rib 27, as seen in FIG. 6. The outlet aperture 32 has, in planes normal to the axis of the housing 11, a maximum dimension between a first portion 35*a* of the outlet aperture 32 adjacent a second lateral edge 34*b* of the seal 24 and a second portion 35*b* of the outlet aperture 32 to the same side as the seal 24 of the diameter of the housing 11 that is normal to a diameter of the housing 11 that passes through the centre of the rib 27, as also seen in FIG. 6.

Figure 10:
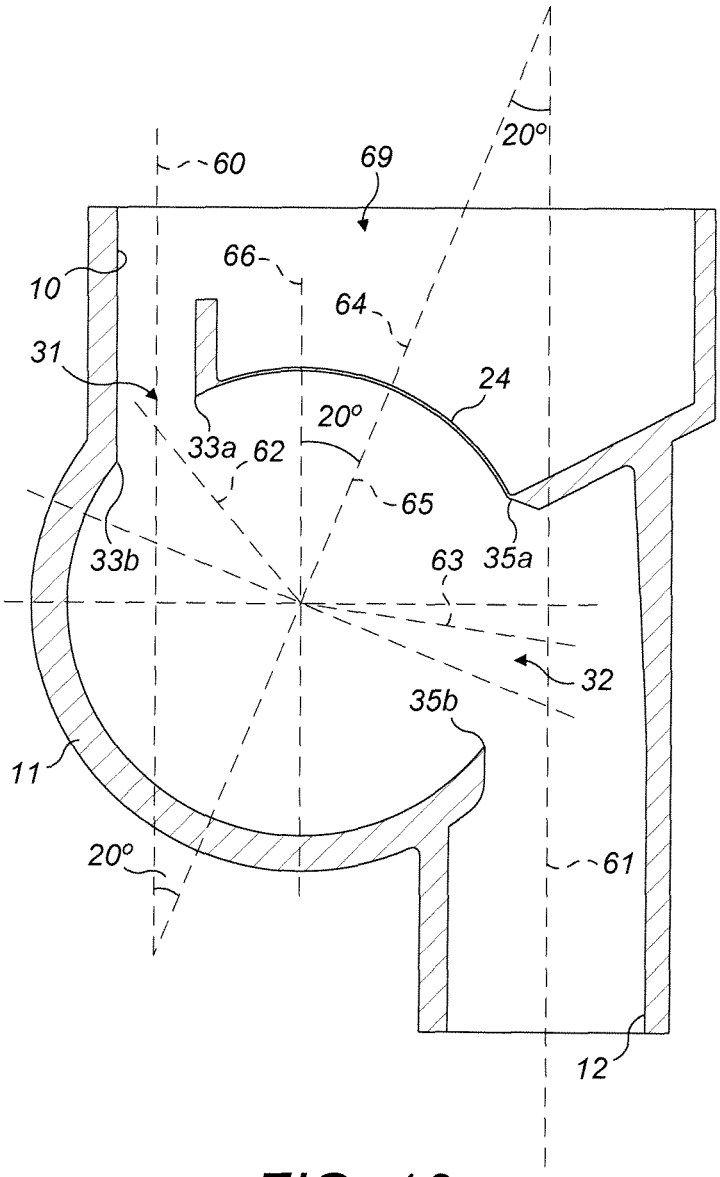
FIG. 10 is a cross-section through a moulded part produced using the cores of FIGS. 7 and 8.

As seen in FIGS. 3, 6 and 10, the contact radius 65 of the housing 11 that passes through the centre of the rib 27 (and thus through the line of sealing contact between the seal 24 and the rotor 37) is rotated relative to the axis of the inlet 10 (and thus relative to the axis of the outlet 12) by about 20° so that the contact radius 65 intersects an imaginary extension of the axis 61 of the outlet 12 at the same angle. The purpose of this is to position the outlet aperture 32 so that it faces in a direction at 90° or more to the axis of the outlet 12. This gives significant advantages in the manufacture of the pump assembly as will be described below.

The housing 11 contains a rotor 37 that is inserted into the housing 11 through the open end and that may be shaped in any convenient way such as any of the ways described in WO2006/027548 and WO2010/12229 to form with the housing 11 two chambers 38*a*, 38*b*. The rotor 37 includes a trunnion 43 by which it is axially positioned at the closed end 39 of the housing 11. The open end of the housing 11 is closed by a cap 40 carrying a rubber lip seal 44 (see FIG. 5) that prevents the leakage of fluid from the housing 11 through the open end around the cap 40. A spindle 41 is formed at the end of the rotor 37 and has a shaped interior aperture for receiving a complimentarily shaped drive shaft of a drive (not shown). The drive shaft bottoms out on the blind end of the aperture and the rotor 37 is positioned by and between the drive shaft and the cap 40 via the trunnion 43. The drive shaft may be spring loaded in known fashion to accommodate manufacturing tolerances.

The positioning of the second portions 33*b*, 35*b* of the inlet and outlet apertures 31, 32 mostly or wholly to the same side of a diameter of the housing 11 as the seal 24, as described above, is necessary because the rotor 37 has two apices spaced by 180° and it is necessary for one apex always to be in contact with the portion of the housing 11 between the inlet aperture 31 and the outlet aperture 32 in the direction of rotation of the rotor 37 to prevent direct communication between the inlet 10 and the outlet 11.

The exterior of the outlet 12 is provided with a web 42 to provide alignment in automated equipment handling the pump assembly.

The pump assembly operates as follows.

The inlet 10 is connected to a supply of liquid that may, for example, be a wine box or other beverage so that liquid enters the open end of the inlet 10. The pump is capable of pumping a wide range of liquids and gasses including viscous liquids and suspensions such as paint (included in the definition of "fluids"). The outlet 12 is connected to a destination for the fluid such as a receptacle for a beverage, for example a wine glass, so that the liquid exits the open end of the outlet 12. The rotor 37 is connected to a drive (not shown) which is preferably a controlled drive such as a computer controlled drive allowing controlled adjustment of the angular velocity and position of the rotor.

Starting from the bottom dead centre position shown in FIG. 6, fluid enters the chamber 38*a* at the inlet aperture 31 and exits the chamber 38*b* at the outlet aperture 32. The diaphragm seal 24 is urged by the spring 23 into engagement with the rotor 11 to prevent fluid passing from the outlet 12 to the inlet 10.

On continued rotation of the rotor 37 anti-clockwise as shown in FIG. 6, the second shaped chamber 38*b* is decreased in volume by the rotation of the rotor 37 to force fluid from the second chamber 38*b* through the outlet aperture 32 to the outlet 12 while the volume of the first chamber 38*a* increases to draw fluid in from the inlet 10 through the inlet aperture 31. The diaphragm seal 24 remains in contact with the rotor 11 along the sealing line under the action of the spring 23.

Further rotation of the rotor 11 towards the bottom dead centre position (in which the rotor 37 is rotated by 90° from the position shown in FIG. 6) results in the first chamber 38*a* being closed by the housing 11 and containing a predetermined volume of fluid. The second chamber 38*b* is partially in communication with the outlet 12 through the outlet aperture 32 and partly in communication with the inlet aperture 31 for the receipt of fluid from the inlet 10. The diaphragm seal 24 remains in contact with the rotor 37 under the action of the spring 23 to prevent the passage of fluid between the outlet 12 and the inlet 10.

The continued rotation of the rotor 11 (beyond 90° from the position shown in FIG. 6) results in the first chamber 38*a* opening onto the outlet aperture 32 so that substantially all of the fluid in the first chamber 38*a* exits to the outlet 12. The second chamber 38*b* communicates with the inlet 10 so drawing further fluid into the second chamber 38*b*. The diaphragm seal 12 remains in contact with the rotor 11 along the sealing line under the action of the spring 23.

Continued rotation of the rotor 11 continues this action to pump fluid from the inlet 10 to the outlet 12.

This action is described in more detail in our WO2006/027548 and WO2010/12229.

During this rotation, the spring 23 is alternately compressed and allowed to expand. The spring 23 is located in the channel 22 and, since the channel 22 is located in the chamber 69, the spring 23 is surrounded by the liquid being pumped. If the channel 22 was closed, or if the channel 22 accessed the chamber 69 (shown in FIG. 10) only via restricted pathways, liquid between the spring 23 and the channel 22 could not escape as the spring flexes and could not enter as the spring 23 expands and this would have an adverse effect of the action of the spring 23 to urge the seal 24 into contact with the rotor 37. To prevent this, the channel 22 is provided with a series of slots 45 (see FIG. 7) that allow liquid to escape the channel 22 as the spring 23 compresses and to allow liquid to enter as the spring 23 expands.

Figure 8:
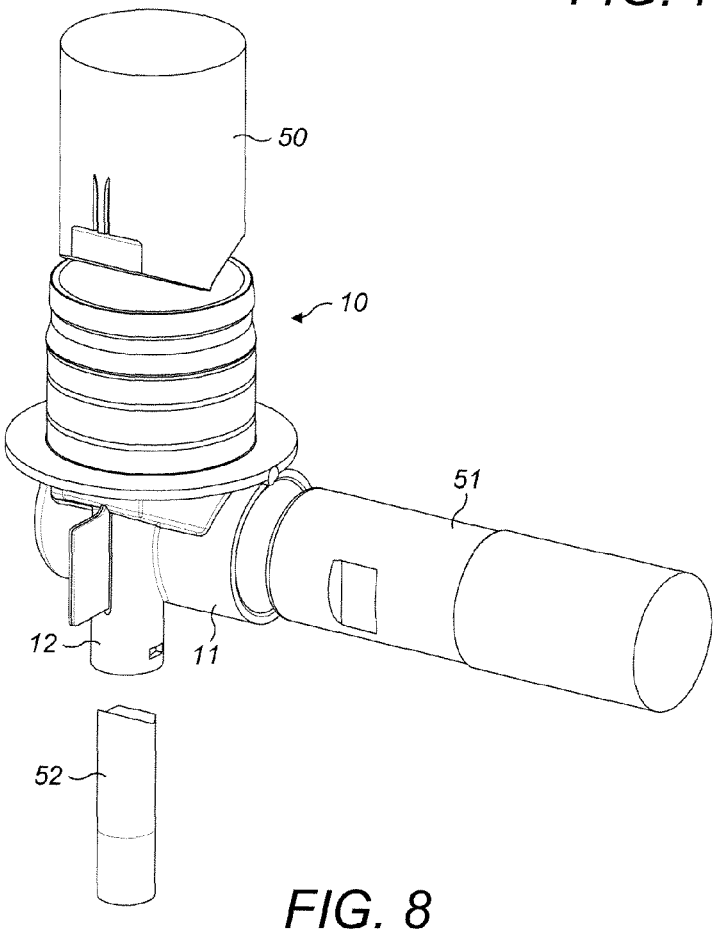
FIG. 8 is a perspective view of a moulded part for forming the pump assembly of FIGS. 1 to 6 and showing three mould cores retracted.
Figure 9:
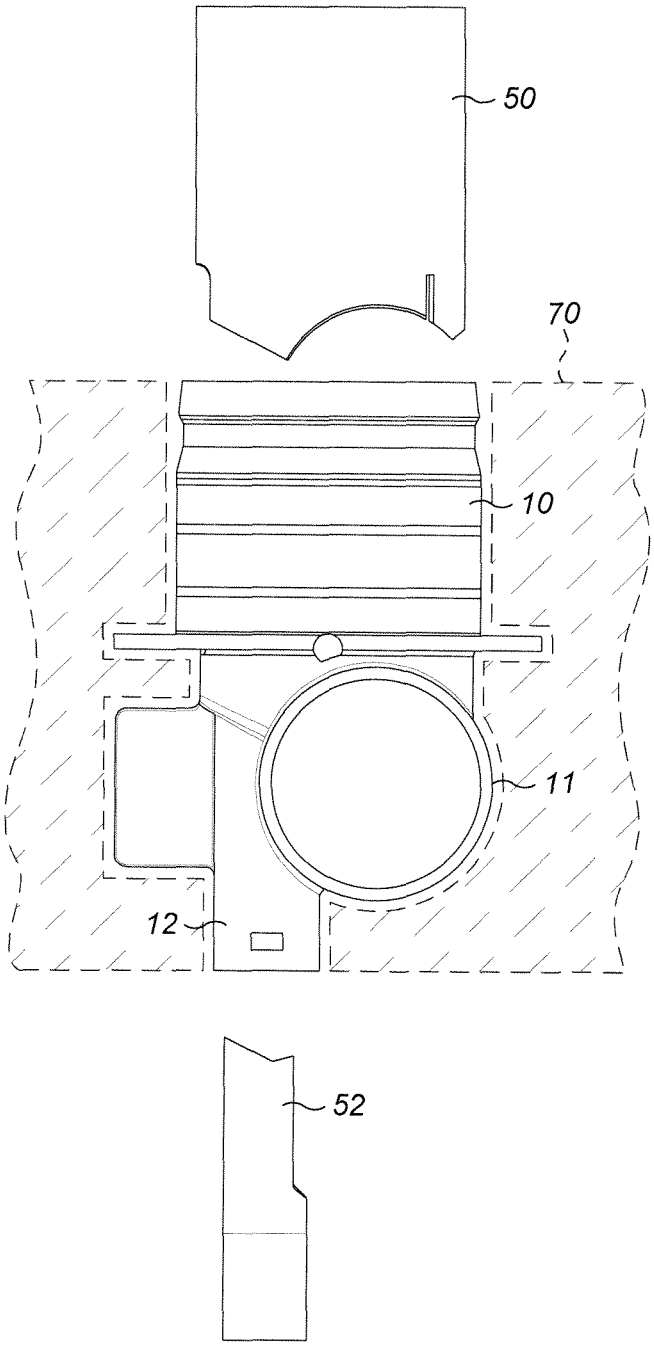
FIG. 9 is a side elevation of the moulded part and the mould cores of FIG. 7.

The inlet 10, the housing 11, the inlet aperture 31, the outlet 12, the outlet aperture 32, the chamber 69 (shown in FIG. 10) and the diaphragm seal 24 are formed in one-piece as a single moulded part in a single moulding operation. Referring next to FIGS. 8 and 9, the interior of the inlet 10, the interior of the chamber 69, the inlet aperture 31, part of the housing 11 and the seal 24 of the moulded part are formed by a first core 50 that co-operates with a second core 51. These core parts 51, 52 co-operate with an outer core 70 (shown in outline in FIG. 9) that forms the exterior of the housing 11 and the exteriors of the inlet 10 and the outlet 12. The first core 50 moves in a linear path along the axis of the chamber 69 (shown in FIG. 10) into and out of co-operation with the second core 51 along the part of the outer core 70 forming the inlet 10. The interior of the outlet 12, the outlet aperture 32 and part of the housing 11 of the moulded part are formed by a third core 52 that co-operates with the second core 51 and that moves along the part of the outer core 70 forming the outlet 12 in a linear path along the axis of the outlet 12 into and out of co-operation with the second core 51. Since the outlet aperture 32 opens in a direction towards the open end of the outlet 12 as a result of the rotation of the seal 24 relative to the inlet 10 and the outlet 12, the outlet aperture 32 can be formed between co-operating faces of the second and third cores 51, 52 without requiring complicated cores. The first core 50 and the third core 52 thus travel along parallel paths.

This simple axial movement of the third core 52 is only possible because of the rotation of the contact radius 65 relative to the inlet 10 and the outlet 12. Neither the first nor the third core 50, 52 has a portion of the second core 52 in its path in the moulding operation so that the edge 35*a* of the outlet aperture 12 adjacent the seal 24 is at least as close to the axis 61 of the outlet 12 as the opposite edge 35*b*. If the direction of opening of the outlet aperture 32 is away from the open end of the outlet 12, it would be necessary to use more than one core, or a complicated angled core or a rotating core or multiple cores, to form the outlet 12 and the outlet aperture 32. Thus, this orientation of the outlet aperture 32 as described above simplifies and reduces the cost of manufacture of the pump assembly.

It is necessary to rotate the position of the seal 24 and the spring 23 and the position of the outlet aperture 32—rather than spacing the outlet aperture 32 from the seal 24—since, if the first portion 35*a* of the outlet aperture 12 is spaced from the associated edge 34*a* of the seal 24, it is possible for a low pressure zone to be created between the housing 11 and the chambers 38*a*, 38*b* in this zone. As a result, this zone is not completely scavenged and this affects adversely the performance of the pump assembly.

FIG. 10 shows a cross-section of a moulded part formed as described above. The axis 60 of the inlet 10 is parallel to the axis 61 of the outlet 12. The direction of opening 62 of the inlet aperture 31 is towards the open end of the inlet 10. The centreline 64 of the diaphragm seal 24 lies on the contact radius 65 of the housing 11 that is rotated by about 20° away from the axis 60 of the inlet 10 and towards the axis 61 of the outlet 12. The effect of this is that the direction of opening 63 of the outlet aperture 32 is at 90° or more to the axis 61 of the outlet 12 so that the outlet aperture 32 faces the open end of the outlet 12. The edge 35*b* of the outlet aperture 32 is spaced by more than 180° from the edge 33*b* of the inlet 31, in a clockwise direction as shown in FIG. 10 to prevent communication between the inlet 31 and the outlet 32 with the rotor 37 shown in FIG. 6 that forms two chambers 38*a* 38*b* and thus has two portions contacting the housing 10 and separated by 180°.

It will be appreciated that there are many variations to the pump assembly described above with reference to the drawings. The rotor 37 need not form just two chambers 38*a*, 38*b*; it could form three or more chambers. The spring 23 described above with reference to the drawings may be replaced by any suitable spring.

Although the chamber 69 and the outlet 12 are shown as having respective circular cross-sections, this is not essential and they may be of any convenient cross-section such as square, oval or rectangular provided the outlet 12 can be formed by a single mould tool that can be withdrawn along the length of the outlet 12. In that case, references above to the axis of the inlet and outlet are replaced by references to the centrelines of these parts. In addition, the inlet aperture 31 and the outlet aperture 32 may be any convenient shape. They may be circular about a radius of the housing 11 or of any convenient alternative shape.

As described above, the outlet aperture 32 (and the inlet aperture 31) lies to the same side of a diameter of the housing 11 that is normal to a diameter of the housing 11 passing through the point of contact of the seal 24 with the rotor 37. This is necessary because the rotor has two apices spaced by 180° and any angular lengthening of the inlet and outlet apertures 31, 32 would allow direct communication between the inlet 10 and the outlet 12. If the rotor 37 had three or more apices, the inlet and outlet apertures 31, 32 could have a greater angular extent past such a diameter. In this case, the minimum requirement is that one apex is always in contact with the housing 11 between the inlet aperture 31 and the outlet aperture 32 to prevent communication between the two. In practice, it is preferred to have two or more apices in such contact as this improves the seal between the inlet 10 and the outlet 12 and so allows higher operating pressures. In addition, the provision of two or more apices in contact with the housing 11 provides additional support for the resilient housing 11 and reduces distortion.

The inlet aperture 31 and the outlet aperture 32 are described above as identically shaped and disposed. This need not be the case. The inlet aperture 31 could be differently arranged—since the angular movement of the seal 24 serves simply to open the inlet aperture 31 relative to the inlet 10 and so does not cause a problem for the removal of the associated mould tool along the length of the inlet 10.

As shown, the axes of the inlet 10 and the outlet 12 are parallel. Although desirable, this need not be the case, and they could be angled relative to one another.

Although, as described above, the outlet aperture 32 opens in a direction that is at 90° to the axis of the outlet 12, this may be varied so that this direction is more towards the open end of the outlet 12 in which case this direction will subtend an obtuse angle with the axis of the outlet 12. It is necessary only that the direction of opening of the outlet aperture is not away from the open end of the outlet 12. Accordingly, the 90° angle described above is the minimum angle. This variation is, of course, subject to the other constraints on the position and extent of the inlet and outlet apertures 31, 32 such as the need always to have one apex of the rotor 37 in contact with the housing 11 between the inlet aperture 31 and the outlet aperture 32 in the direction of rotation of the rotor, as mentioned above.

As described above, the process for forming the moulded part including the inlet 10, the housing 11, the outlet 12 and the diaphragm seal 24 are formed in a one-shot moulding process. This is not essential. They may be formed in a two shot process as, for example, described in PCT/EP2012/069643. In one example of such a method, the inlet 10, the housing 11 and the outlet 12 are formed using mould tools and cores generally as described above. In contrast to the process described above with reference to the drawings, however, in a first moulding operation, the first core 50 and the second core 51 co-operate to form the housing 11 with an aperture for receiving the diaphragm seal 24. In a second moulding operation, the first core 50 is retracted slightly to provide a space between the first and second cores 50, 51 at the aperture that is the required thickness of the diaphragm seal 24 and the third core 52 is retracted slightly to form a path for injection of a suitable molten material into the space to form the diaphragm seal 24 in one-piece with housing 11.

As described above, the seal 24 and the spring 23 are located in the inlet 10. This is not essential. The seal 24 and the spring could be outside the inlet 10.

The invention claimed is:

1. A pump assembly comprising:

an inlet having an open end, an outlet having an open end and a housing having an inlet aperture in fluid connection with the inlet at an end of the inlet opposite said open end and an outlet aperture in fluid connection with the outlet at an end of the outlet opposite said open end, a rotor within the housing and shaped to form with an interior surface of the housing at least one chamber that on rotation of the rotor conveys fluid from the inlet aperture to the outlet aperture, the housing including a seal located between the inlet and the outlet and urged into contact with the rotor along a sealing line to prevent the passage of fluid past the rotor from the outlet to the inlet, the inlet aperture and the outlet aperture having respective portions adjacent respective edges of the seal and the inlet and the outlet having respective centre lines that are parallel to, and spaced apart from one another, and lie in a plane normal to the axis of the housing, a radius of the housing passing through the sealing line being angled and non-parallel relative to the centre lines of the inlet and the outlet;

the sealing line located between the centre lines of the inlet and the outlet; and wherein in use, fluid will flow through the inlet and the outlet in the same direction.

2. The pump assembly according to claim 1 wherein the angle is 20°.

3. The pump assembly according to claim 1 wherein the outlet aperture has a portion remote from the edge of the seal, the adjacent portion being at least as close to the centre line of the outlet than the remote portion.

4. The pump assembly according to claim 1 wherein the outlet has a circular cross-section.

5. The pump assembly according to claim 1 wherein the inlet receives fluid from a chamber.

6. The pump assembly according to claim 5 wherein the chamber forms a connector for connecting the pump assembly to a source of fluid.

7. A method of manufacturing a pump assembly comprising an inlet having an open end, an outlet having an open end and a housing having an inlet aperture in fluid connection with the inlet at an end of the inlet opposite said open end and an outlet aperture in fluid connection with the outlet at an end of the outlet opposite said open end, a rotor within the housing and shaped to form with an interior surface of the housing at least one chamber that on rotation of the rotor conveys fluid from the inlet aperture to the outlet aperture, the housing including a seal located between the inlet and the outlet and urged into contact with the rotor along a sealing line to prevent the passage of fluid past the rotor from the outlet to the inlet, the inlet aperture and the outlet aperture having respective portions adjacent respective edges of the seal and the inlet and the outlet having respective centre lines that are parallel to one another, and lie in a plane normal to the axis of the housing, a radius of the housing passing through the sealing line being angled relative to the centre lines of the inlet and the outlet; the method comprises forming the inlet and the outlet with respective mould tools movable only in a rectilinear direction.

8. The method according to claim 7 wherein the mould tools co-operate with an additional mould tool for forming the housing interior of the housing.

9. The method according to claim 8 wherein the housing, the inlet, the outlet and the seal are formed in a one-shot moulding process.

10. The method according to claim 8 wherein the housing, the inlet and the outlet are formed in a first moulding step and the seal is formed in a second moulding step.

11. The method according to claim 7 wherein the housing, the inlet, the outlet and the seal are formed in a one-shot moulding process.

12. The method according to claim 7 wherein the housing, the inlet and the outlet are formed in a first moulding step and the seal is formed in a second moulding step.

13. A pump assembly comprising:

an inlet having an open end, an outlet having an open end and a housing having an inlet aperture in fluid connection with the inlet at an end of the inlet opposite said open end and an outlet aperture in fluid connection with the outlet at an end of the outlet opposite said open end, a rotor within the housing and shaped to form with an interior surface of the housing at least one chamber that on rotation of the rotor conveys fluid from the inlet aperture to the outlet aperture, the housing including a seal located between the inlet and the outlet and urged into contact with the rotor along a sealing line to prevent the passage of fluid past the rotor from the outlet to the inlet, the inlet aperture and the outlet aperture having respective portions adjacent respective edges of the seal and the inlet and the outlet having respective centre lines that are parallel to one another, and lie in a plane normal to the axis of the housing, a radius of the housing passing through the sealing line being angled relative to the centre lines of the inlet and the outlet; and the seal comprises a flexible diaphragm and is supported by an elongate spring member formed from an elastomeric material, and which comprises spaced arms interconnected by a base portion carrying a rib on its exterior surface, the rib extending parallel to the longitudinal axis of the spring member;

wherein the rib presses against an under-surface of the seal, thus sealing the seal against the rotor along a contact line opposite the sealing line.

14. The pump assembly according to claim 13, wherein the centre lines of the inlet and outlet are spaced apart from each other.

15. The pump assembly according to claim 13, wherein the radius passing through the sealing line is non-parallel relative to the centre lines of the inlet or outlet.

16. The pump assembly according to claim 13, wherein the sealing line is located between the centre lines of the inlet and the outlet.

17. The pump assembly according to claim 13, wherein in use, the pumped fluid will flow in the same direction through the inlet and the outlet.

* * * * *